US011566441B2

(12) United States Patent
Raatikainen

(10) Patent No.: US 11,566,441 B2
(45) Date of Patent: Jan. 31, 2023

(54) DOOR LOCK

(71) Applicant: Abloy Oy, Joensuu (FI)

(72) Inventor: Juha Raatikainen, Kontiolahti (FI)

(73) Assignee: ABLOY OY, Joensuu (FI)

( * ) Notice: Subject to any disclaimer, the term of this patent is extended or adjusted under 35 U.S.C. 154(b) by 322 days.

(21) Appl. No.: 16/761,727

(22) PCT Filed: Nov. 1, 2018

(86) PCT No.: PCT/FI2018/050794
§ 371 (c)(1),
(2) Date: May 5, 2020

(87) PCT Pub. No.: WO2019/097111
PCT Pub. Date: May 23, 2019

(65) Prior Publication Data

US 2020/0340271 A1 Oct. 29, 2020

(30) Foreign Application Priority Data

Nov. 15, 2017 (FI) ..... 20176022

(51) Int. Cl.
*E05B 15/00* (2006.01)
*E05B 63/16* (2006.01)
(Continued)

(52) U.S. Cl.
CPC ..... *E05B 15/0013* (2013.01); *E05B 15/0033* (2013.01); *E05B 17/007* (2013.01);
(Continued)

(58) Field of Classification Search
CPC ..... E05B 15/0013; E05B 15/0033; E05B 15/00563; E05B 15/008; E05B 15/16;
(Continued)

(56) References Cited

U.S. PATENT DOCUMENTS 97,332 A * 11/1869 Woodruff ..... E05B 15/0033 292/336.5
4,502,720 A * 3/1985 Fayerman ..... E05B 65/104 292/357
(Continued)

FOREIGN PATENT DOCUMENTS

DE 202013008983 U1 4/2014
EP 1291478 B1 7/2006
(Continued)

*Primary Examiner* — Christopher J Boswell
(74) *Attorney, Agent, or Firm* — Muncy, Geissler, Olds & Lowe, P.C.

(57) ABSTRACT

The door lock according to the invention comprises a lock body, a bolt, a follower, a driver on both sides of the follower, and a latch solution to connect at least one of the drivers in force transmission connection and out of force transmission connection with the follower. The door lock further comprises a baffle plate between the follower and the driver at least on one side of the follower. The baffle plate comprises at least one support surface, which is set against the lock body or against a part which is connected to the lock body in a fixed manner. The baffle plate can thus not be rotated in relation to the lock body. A baffle plate which cannot be rotated prevents turning force from being transmitted from the driver to the follower.

8 Claims, 1 Drawing Sheet

Figure 1:
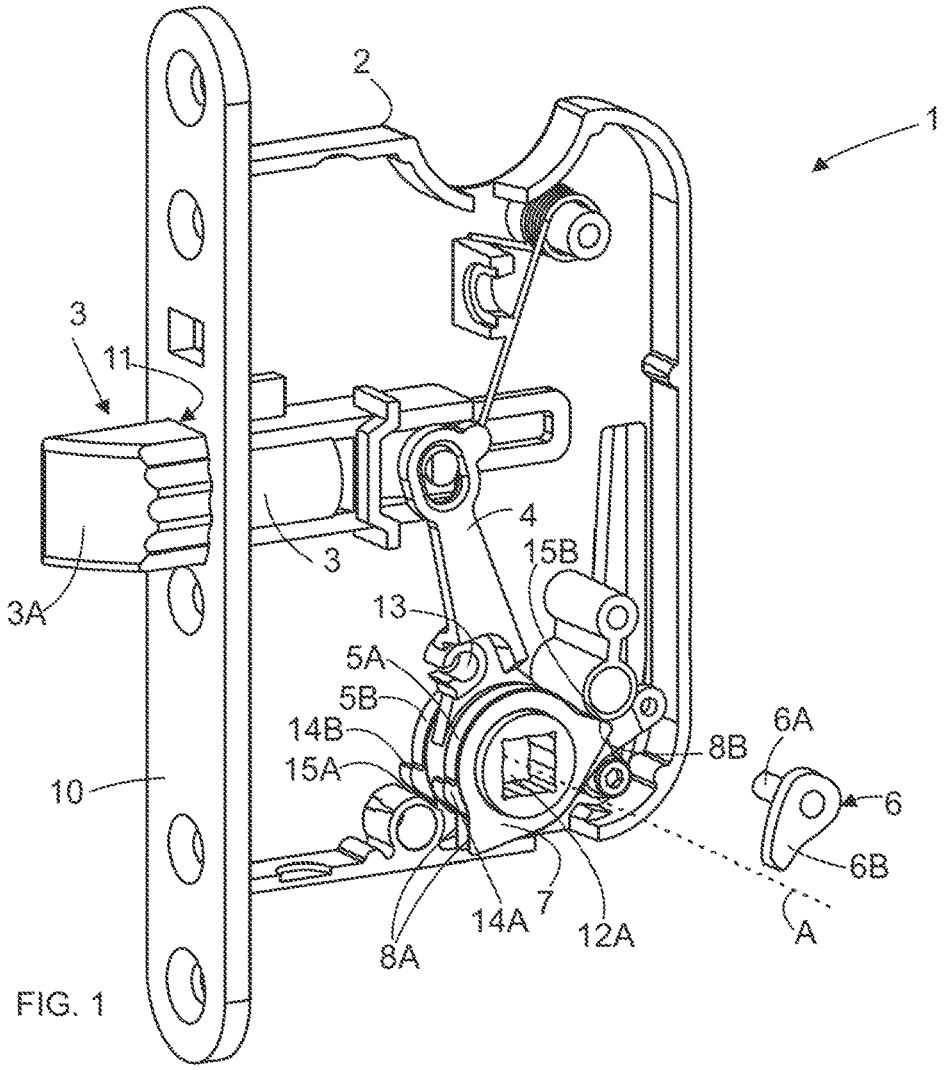

(51) Int. Cl.
*E05B 15/16* (2006.01)
*E05B 17/00* (2006.01)

(52) U.S. Cl.
CPC ..... *E05B 63/16* (2013.01); *E05B 2015/1628* (2013.01); *E05B 2015/1678* (2013.01)

(58) Field of Classification Search
CPC ..... E05B 15/1614; E05B 15/1635; E05B 2015/1628; E05B 2015/1678; E05B 2015/1685; E05B 3/08; E05B 17/007; E05B 63/16
See application file for complete search history.

(56) References Cited

U.S. PATENT DOCUMENTS 5,259,652 A * 11/1993 Adams ..... E05B 63/16 292/169.21
5,890,385 A * 4/1999 Lee ..... E05B 63/16 292/336.3
6,978,646 B2 * 12/2005 Raatikainen ..... E05B 47/0688 292/336.3
8,162,358 B2 * 4/2012 Lin ..... E05B 63/16 70/149
8,201,858 B1 * 6/2012 Moon ..... E05B 63/16 292/33
8,347,668 B2 * 1/2013 Min ..... E05B 63/16 292/336.5
8,371,627 B2 * 2/2013 Chiang ..... E05B 63/0065 292/164
8,641,104 B1 * 2/2014 Tien ..... E05B 15/0013 292/244
9,169,666 B2 * 10/2015 Hodgin ..... E05B 3/08
9,784,017 B2 * 10/2017 Huang ..... E05B 55/12
2010/0225123 A1 * 9/2010 Chiang ..... E05B 15/0013 292/1.5
2010/0263418 A1 * 10/2010 Moon ..... E05B 55/00 292/61
2022/0034122 A1 * 2/2022 Holst-Larsen ..... E05B 63/16

FOREIGN PATENT DOCUMENTS

EP 2754788 A1 7/2014
FI 115479 B 5/2005
RU 2249087 C2 3/2005
RU 2353742 C2 4/2009
WO WO-02/059440 A1 8/2002
WO WO-2005042886 A1 5/2005
WO WO-2007021182 A2 2/2007

* cited by examiner

DOOR LOCK

FIELD OF THE INVENTION

The invention relates to door locks. Particularly, the invention relates to door locks, where a split spindle is used. A split spindle means a spindle arrangement, which comprises two spindles for both sides of the door. Additionally, there are embodiments, where the spindles are connected together with a connecting pin.

PRIOR ART

It is known that lock bodies have a bolt, which can be arranged in force transmission connection with a handle's spindle. The spindle is placed in the spindle's axis point. A follower and drivers on both sides of the follower are also placed in the spindle's axis point.

The handle is connected to the spindle. When the handle is turned, the spindle also turns, whereby it turns the driver, which the spindle is in direct contact with. Between the driver and the follower there is a controllable latch, which can be arranged to convey force from the driver to the follower. If the latch is turned to be in force transmission connection, then the turning driver guides the turning force of the handle via the latch to the follower, which causes the follower to turn. The follower is connected to the bolt, whereby the turning of the follower caused by the handle pulls the bolt into the door lock. Thereafter the door can be pulled or pushed open. When the turning of the handle is stopped, the door lock usually has a spring arrangement, which returns the handle to its basic position, simultaneously thus also turning the driver and follower to the basic position. The basic position means the position, where no turning force is directed onto the handle. Thus, the driver and follower are also in the basic position, whereby the end of the bolt is out of the door lock. So the bolt keeps the door closed against the door frame. If the latch is not in force transmission connection, then the turning force of the handle is not conveyed to the follower and the end of the bolt remains outside.

The above-described operation can be arranged on both sides of the door, because there are drivers on both sides of the follower. People usually talk about an inside and an outside. There are different kinds of latch solutions, with which different functions are achieved. The latch solution can make possible a simultaneous force transmission from both drivers to the follower. The latch solution can control the force transmission connection of only one of the drivers. Additionally, one of the drivers, usually the inside driver, can even be arranged in a fixed, i.e. continuous force transfer connection with the follower, whereby the bolt can always be pulled inside the door lock with the handle on the inside of the door.

When the handle is turned, it can be attempted to simultaneously turn it also sideways, so that the contact pressure between the driver and the follower would be great enough to turn the follower along with the driver. It is thus attempted to create the largest possible friction between the driver and the follower. By operating thus, the aim is to pull the bolt inside the door lock, even if the follower is not connected via the latch in force transfer connection with the driver. In other words, with such an abnormal operation, the aim is to open a locked door, even without authorization.

It is known that there are additionally also baffle plates between the follower and the drivers, on both sides of the follower. The baffle plates are round plates, which have a center hole. The purpose of the baffle plates is to reduce the wear of the drivers and follower. Even if baffle plates are used between the follower and drivers, the above-described abnormal operation for opening a locked door is possible.

BRIEF DESCRIPTION OF THE INVENTION

The object of the invention is to provide a solution, which prevents the above-described problem. The object is achieved in the manner described in the independent claim. The dependent claims present different embodiments of the invention.

The door lock 1 according to the invention comprises a lock body 2, a bolt 3, a follower 4, a driver 5A, 5B on both sides of the follower, and a latch solution 6 to connect at least one of the drivers 5A, 5B in force transmission connection and out of force transmission connection with the follower 4. The door lock 1 further comprises a baffle plate 7, 7A between the follower 4 and the driver 5A, 5B at least on one side of the follower. The baffle plate 7, 7A comprises at least one support surface 8A, 8B, 8C, which is set against the lock body 2 or against a part which is connected to the lock body in a fixed manner. The baffle plate can thus not be rotated in relation to the lock body 2. A baffle plate which is unturnable prevents turning force from being transmitted from the driver to the follower.

LIST OF FIGURES

Figure 3:
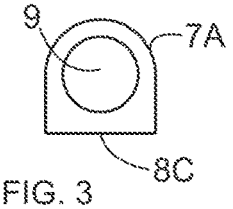
Figure 2:
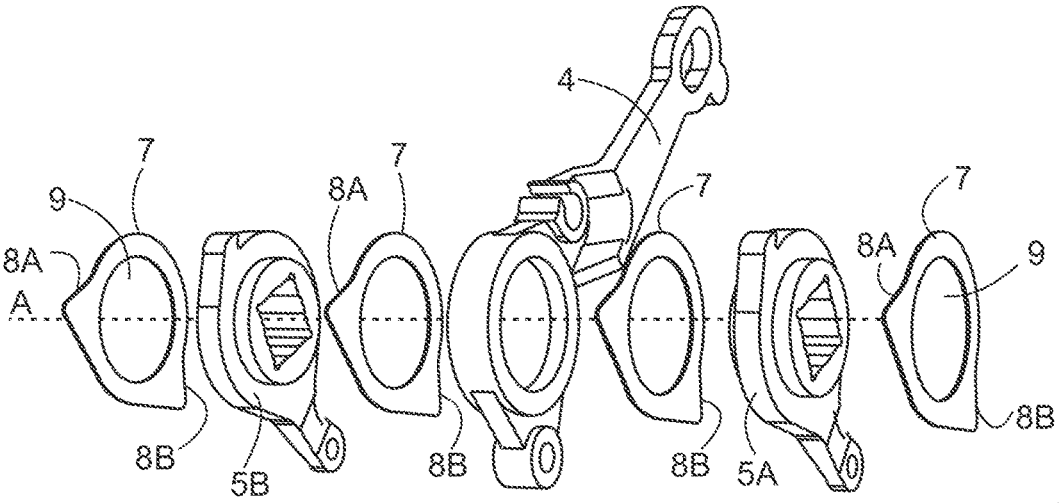

In the following, the invention will be described in more detail with reference to the appended figures, in which FIG. 1 shows an example of a door lock according to the invention, FIG. 2 shows features of the invention in more detail than the example, and FIG. 3 shows one example of an embodiment of the baffle plate.

DESCRIPTION OF THE INVENTION

FIG. 1 shows an example of a door lock 1 according to the invention. The door lock comprises a lock body 2, a bolt 3, a follower 4, a driver 5A, 5B on both sides of the follower, and a latch solution 6 to connect at least one of the drivers 5A, 5B in force transmission connection and out of force transmission connection with the follower 4. It is clear that the door lock also comprises other parts than the ones mentioned above. They are however not shown in the figures for the sake of clarity, whereby the invention and its functionality can be shown clearly. For example, only a part of the lock body 2 is shown, whereby the above-mentioned parts placed in the lock body can be seen. Someone skilled in the art knows that a part, which corresponds to the part of the lock body 2 seen in FIG. 1, would cover the parts placed inside the lock body when seen from the direction of FIG. 1. A lock cylinder and/or electronic locking system is also not shown in the figures.

FIG. 1 also shows a front plate 10, which is connected to the lock body. The front plate is often seen as a part of the lock body, and it has an opening 11 for the bolt 3. In FIG. 1 the end 3A of the bolt is outside of the door lock, more precisely outside the lock body 2, whereby it keeps the door closed, when the door is against the frame of the door opening. The frame has a counter plate (not shown in the figures), in which the end 3A of the bolt settles. In the door lock 1, more precisely in its lock body 2, there is a point, which is called the axis point of the spindle. The follower and the drivers are set in a row in the direction of the axis line A of the axis point of the spindle. The drivers, which can be called the inside driver and the outside driver, are on both sides of the follower. The drivers 5A, 5B and follower 4 are arranged to turn in relation to the axis line. Both drivers have a spindle hole 12A, 12B for one of the spindles of the split spindle. The spindle installed in the spindle hole turns the driver, when the handle connected to the spindle is turned. If the latch solution 6 is guided (for example electronically or mechanically) into a force transmission position, the turning force is transmitted via the latch solution 6 from the driver 5A, 5B to the follower 4, which further moves the bolt 3 inside the lock body 2. Thus, the end 3A of the bolt moves completely or almost completely inside the lock body. If the latch solution 6 is not guided into the force transmission position, a turning force directed onto the handle only turn the drivers 5A, 5B via the spindle. In the embodiment of FIG. 1 the follower 4 comprises a latch fastening point 13, where the axis pin 6A of the latch solution is set so that it can be turned. Additionally, the latch solution comprises the actual latch part 6B. In FIG. 1 the latch solution is shown apart from the latch fastening point 13, so that the features of the invention are seen more clearly. Both drivers 5A, 5B have a counterpart 14A, 14B, which is against the latch part 6B, when the latch solution is guided into the force transmission position. In FIG. 1 the drivers and follower are in the basic position, whereby no turning force is directed onto them via the spindle.

The split spindle, its parts and the handle are not shown in the figures, because they are often installed in the door lock separately. Thus, handles with a desired look can be selected to be used with the door lock, which is known as such.

The door lock 1 further comprises a baffle plate 7, 7A between the follower 4 and the driver 5A, 5B at least on one side of the follower. FIG. 2 shows more clearly the placement of the baffle plate or baffle plates in connection with the follower 4 and drivers 5A, 5B. The baffle plate 7 can thus be placed on only one side of the follower, between it and the driver. There can be a baffle plate 7, 7A on both sides of at least one of the drivers 5A, 5B (i.e. only one of the drivers or both drivers). The baffle plates can also be placed on both sides of the follower 4.

The baffle plate 7, 7A comprises at least one support surface 8A, 8B, 8C, which is set against the lock body or against a part which is connected to the lock body in a fixed manner. Thus, the baffle plate is unturnable in relation to the lock body 2. The support surface or support surfaces prevent the baffle plate from turning with the driver 5A, 5B and thus the baffle plate also does not transmit turning force directed onto the driver to the follower. Even if an attempt were made to prize the handle and the thereto connected spindle to the side to achieve a sufficient contact pressure between the driver and the follower to transmit turning force, the baffle plate, which does not turn in relation to the lock body 2, prevents the transmission of the turning force.

FIG. 3 shows a second embodiment of a baffle plate 7A, which has one support surface 8A. The baffle plate has a center hole 9. As was mentioned already above, the support surface or support surfaces are against the lock body or against a part connected to the lock body in a fixed manner. The fixed connected part can for example be a support part fastened to the lock body with a screw or rivet, which support part does not turn in relation to the lock body. For example in FIG. 1, the counter surface 15B can be the surface of a part connected to the lock body 2 in a fixed manner, which surface is against the support surface 8B of the baffle plate. The support surface 8A can also be directly against the counter surface 15B of the lock body, e.g. the surface of a shape belonging to the casting of the lock body. Due to the cut of the lock body, it looks in FIG. 1 like the surface 15A is only against the baffle plate or baffle plates installed in connection with the driver 5B, but it must be noted that without the cut, the counter surface 15B would continue also to the driver 5A and the baffle plates 7 installed in connection therewith, therefore being against the support surfaces 8A.

The support surface 8A, 8B, 8C can be a straight surface, which is a cost-effective solution. The support surface can also be curved, if it is desired that it better follows possible curved counter surfaces of the lock body. The embodiment of FIG. 3 has one support surface 8C and the embodiment of FIGS. 1 and 2 has two support surfaces 8A, 8B. There can also be more support surfaces.

The baffle plate 7, 7A is made of a metal suitable for the purpose. Thus, the baffle plate is durable against use and stresses from abnormal use directed onto it. The baffle plate can also be made of some other suitable material, such as for example plastic or ceramic composite. The baffle plate thus prevents the turning force from being transmitted from the driver 5A, 5B to the follower, at the same time as it reduces wear between the driver and follower. If there is a baffle plate on both sides of the driver, as is shown in FIG. 2, more stiffness is achieved, which further reduces detrimental contact pressure caused by prizing of the spindle and handle, whereby the durability of the baffle plates is improved.

The door lock according to the invention can thus be realized in many different ways, as can be discerned from the description above. The invention is thus not limited to the examples presented herein, but can be implemented in different ways within the scope of the independent claim.

The invention claimed is:

1. A door lock, which comprises a lock body, a bolt, a follower, a driver on both sides of the follower, and a latch solution to connect at least one of the drivers in force transmission connection and out of force transmission connection with the follower, wherein the door lock further comprises a baffle plate between the follower and the driver at least on one side of the follower, which baffle plate comprises at least one support surface, which is set against the lock body or against a part which is connected to the lock body in a fixed manner, which baffle plate unturnable in relation to the lock body.

2. The door lock according to claim 1, wherein the baffle plate is made of metal, plastic or ceramic composite.

3. The door lock according to claim 1, wherein the support surface is a straight or curved surface.

4. The door lock according to claim 1, wherein there is a baffle plate on both sides of at least one of the drivers.

5. The door lock according to claim 1, wherein there is a baffle plate on both sides of the follower.

6. The door lock according to claim 5, wherein there is a baffle plate on both sides of the drivers.

7. The door lock according to claim 1, wherein the baffle plate has two or more support surfaces.

8. The door lock according to claim 1, wherein the baffle plate has a center hole.

* * * * *